US005490309A

United States Patent [19]

Velasquez et al.

[11] Patent Number: 5,490,309

[45] Date of Patent: Feb. 13, 1996

[54] FASTENER ASSEMBLY

[76] Inventors: Galilea F. Velasquez, 2501 E. 13th St., National City, Calif. 91950; James R. Steier, 9212 Camino Largo Vista, Spring Valley, Calif. 91977

[21] Appl. No.: 271,777

[22] Filed: Jul. 7, 1994

[51] Int. Cl.[6] ..... A44B 17/00

[52] U.S. Cl. ..... 24/90.1; 24/102 SL; 24/104; 24/DIG. 29

[58] Field of Search ..... 24/93, 104, 105, 24/102 SL, 460, 599.1, 601.6, 113 R, 590, DIG. 29

[56] References Cited

U.S. PATENT DOCUMENTS

| | | | |
|---|---|---|---|
| 589,525 | 9/1897 | Garis . | |
| 1,054,824 | 3/1913 | Carlson . | |
| 1,211,810 | 1/1917 | Anderson | 24/102 SL |
| 1,594,416 | 8/1926 | Kellog | 24/105 |
| 1,849,762 | 3/1932 | Keeney | 24/102 SL |
| 2,174,521 | 10/1939 | Lancaster . | |
| 2,306,961 | 12/1942 | Kral . | |
| 2,538,396 | 1/1951 | Sutin | 24/104 |
| 2,600,894 | 6/1952 | Marien | 24/102 SL |
| 2,656,578 | 10/1953 | Tworek | 24/104 |
| 2,995,792 | 8/1961 | Morton, Jr. . | |
| 3,449,802 | 6/1969 | Mackey | 24/113 R |
| 3,699,617 | 10/1972 | Hofmeister | 24/DIG. 29 |
| 5,095,596 | 3/1992 | Dahood | 24/DIG. 29 |
| 5,134,757 | 8/1992 | Johnson | 24/590 |

FOREIGN PATENT DOCUMENTS

| | | | |
|---|---|---|---|
| 0090567 | 1/1968 | France | 24/104 |

*Primary Examiner*—Victor N. Sakran
*Attorney, Agent, or Firm*—Richard C. Litman

[57] ABSTRACT

The present invention is a fastener assembly that is readily attached to fabric material and the like, without need of sewing. One embodiment of the fastener assembly includes a pair of interlocking male and female members, each for placement upon an opposite side of the fabric material. A coupling, such as a button, cufflink, or snap fastener element, is affixed to one of the members, and a locking device permanently secures the male and female members on opposing sides of the fabric material. Another embodiment of the invention includes two pairs of interlocking male and female members, each having mating couplings configured to removably attach the pairs of members together.

6 Claims, 3 Drawing Sheets

FASTENER ASSEMBLY

BACKGROUND OF THE INVENTION

1. Field of the Invention

The present invention relates to a fastener assembly for attachment to fabric material and the like. More specifically, the present invention relates to a fastener assembly that is easily and quickly attached to the fabric material, without use of threads.

2. Description of the Prior Art

Fastener assemblies for holding together two or more members are well known in the prior art. As seen in U.S. Pat. No. 589,525 issued to Cornelius Weygandt Garis on Sep. 7, 1897, one common utilization of these assemblies is to connect together two or more sections of fabric material. The fastener assembly of this patent includes first and second interlocking components, both of which have a head portion with a shank and elongated arm extending therefrom. To attach the fastener assembly to the fabric material, the elongated arm of the first component is utilized to pierce and penetrate through the fabric material. After this penetration, the first component is positioned so that its elongated arm engages one side of the fabric material, and its head engages the other side of the fabric material. In this position, an aperture within the head of the first component is aligned with the pierced section of the fabric material. To secure both of the components to the fabric material, the elongated arm of the second component is interlocked to the first component by being passed through both the aperture and the pierced section of the fabric material.

Other fastener assemblies usable with fabric material are disclosed in U.S. Pat. No. 2,174,521 issued to George W. Lancaster on Oct. 3, 1939, U.S. Pat. No. 2,306,961 issued to Joseph Kral on Dec. 29, 1942, and U.S. Pat. No. 2,995,792 issued to William D. Morton, Jr. on Aug. 15, 1961. The Lancaster patent shows a detachable button capable of securing to a garment without the use of sewing material. Included in this patent is a first component and a second component, each for positioning upon a different side of the garment. The first component incorporates a shank extending from an elongated plate, and the second component includes a socket integral with a decorative button. The shank of the first component is designed to be pushed through the garment so that it engages, and threads into, the socket of the second component. To prevent rotation of the button relative to the garment, a set of teeth on one of the components protrudes through the garment, and extends into a set of notches arranged within the other component.

The Kral patent illustrates a snap fastener having a flat base and a shank projecting therefrom. The shank is configured for removable securement into the aperture of a supporting panel, and it includes a pair of opposed resilient walls that contract when passing through the aperture. After a portion of these resilient walls have passed completely through the aperture, they expand to frictionally secure the shank within the aperture.

The Morton, Jr. patent discloses a quick release mechanism for releasably holding two elements together to prevent relative movement therebetween. A male member secures to one of the elements, and a female member secures to the other element. The male member includes a plurality of apertures, each for receiving a detent movably secured to the female member. When the detent is positioned within one of the apertures, separation of the male and female members is prevented.

In addition to fastener assemblies usable with fabric material, the prior art discloses fastener assemblies designed specifically for attaching two or more rigid members. In U.S. Pat. No. 1,054,824 issued to John Carlson on Mar. 4, 1913, there is illustrated a one piece fastener assembly for securing together two or more sheet metal members. This fastener assembly includes a shank having a head at one of its ends and a spur at its other end. The portion of the spur adjacent to the shank is substantially wider than the shank, and the portion of the spur remote from the shank tapers to a point. The spur is penetrated through the sheet metal members so that the shank sits within the aperture formed by the passage of the spur. The fastener assembly is then rotated until the sheet metal members are secured between the head of the assembly and the wide portion of the spur.

None of the above inventions and patents, taken either singly or in combination, is seen to describe the instant invention as claimed.

SUMMARY OF THE INVENTION

The present invention is a durable and easy to use fastener assembly for attachment to fabric material and the like. One embodiment of this fastener assembly incorporates a single pair of interlocking elements. One of these elements is a male member for engaging a first side of the fabric material, and the other element is a female member for engaging a second side of the fabric material. A one way locking device permanently secures the male and female members to the fabric material, and a coupling, such as a button, cufflink, or snap fastener element, is affixed to one of the members. Included in the one way locking device is an elongated shank extending from the male member. This shank penetrates through the fabric material, and extends into a shank acceptor integral with the female member. Once inside the shank acceptor, the textured surface of the shank frictionally secures to the surface of the shank acceptor, thereby preventing removal of the shank therefrom.

Another embodiment of the invention includes two pairs of interlocking elements, each being substantially similar to the interlocking male and female members of the first embodiment. The couplings of this embodiment are configured to removably secure to each other, therefore allowing the pairs of interlocking members to temporarily secure together. Such an arrangement is usable as a snap fastener for such items as a shirt and a pair of socks.

Accordingly, it is a principal object of the invention to provide a novel fastener assembly for quick and durable attachment to fabric material or the like.

It is another object of the invention to provide a novel fastener assembly capable of being attached to an article without need of sewing.

It is a further object of the invention to provide a novel fastener assembly having a one way locking device for preventing removal of the assembly from the material to which it is secured.

Still another object of the invention is to provide a novel fastener assembly that will not rotate or shift from the location of its original securement upon a material.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
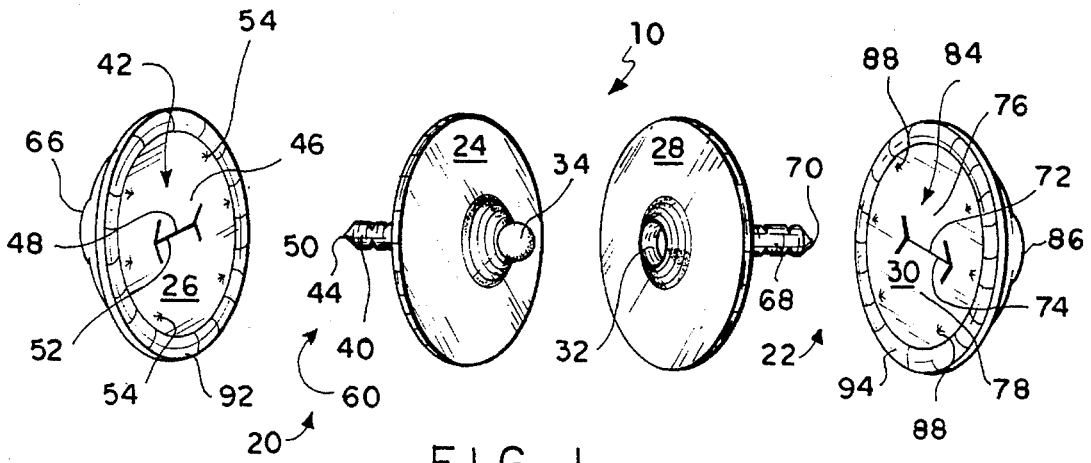
FIG. 1 is a perspective view of the fastener assembly of the invention.
Figure 2:
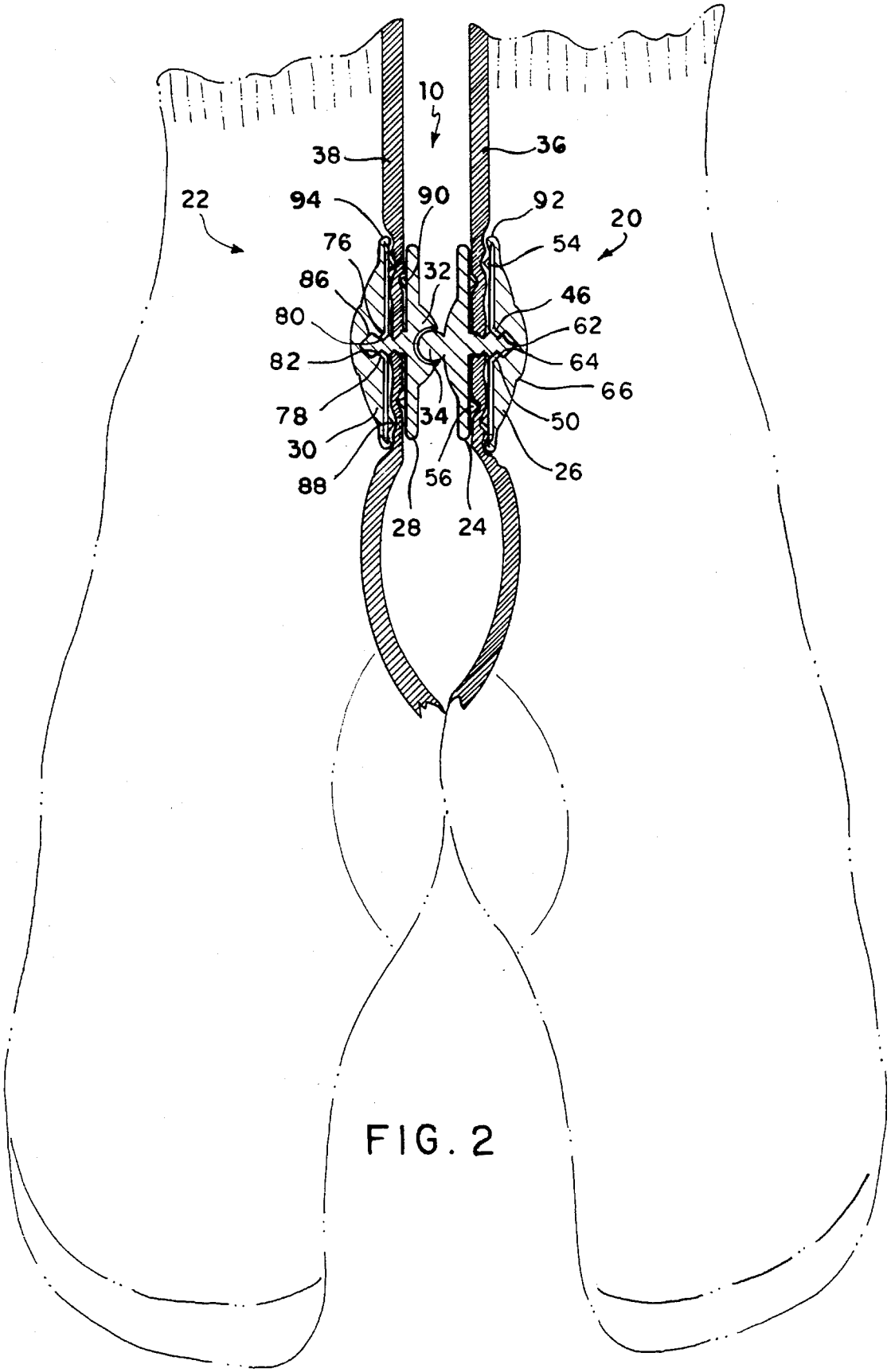
FIG. 2 is an environmental, front elevational view in cross section of the fastener assembly shown in FIG. 1.

Referring to FIGS. 1 and 2, the present invention is a fastener assembly 10 having two pairs 20,22 of interlocking members. First pair 20 includes male member 24 and female member 26, and second pair 22 includes male member 28 and female member 30. Each of these pairs 20,22 permanently secures to a different section of fabric or similar material, and each includes a coupling 32,34 capable of removably securing to the coupling of the other pair 32 or 34.

Although a variety of differently configured couplings could suffice, the preferred configuration of the coupling 32 is a socket, and the preferred configuration of coupling 34 is an engagement part in the form of a ball engageable with socket 32 to frictionally and removably secure the ball therein. In FIG. 1, ball 34 is illustrated to be detached from socket 32, and in FIG. 2, ball 34 is secured within socket 32. As shown in FIG. 2, pair 20 is permanently secured to sock 36, and pair 22 is permanently secured to sock 38. The mating engagement between ball 34 and socket 32 temporarily attaches sock 36 to sock 38. Such an attachment may be desirable during washing and storage of the socks 36,38, and after ball 34 and socket 32 are separated from each other, pairs 20,22 remain attached to the socks 36,38, even while socks 36,38 are worn.

The attachment of members 24,26 to sock 36 is accomplished by a one way locking device having a shank 40 and a shank acceptor 42. Shank 40 extends from male member 24, and it includes a sharp tip 44 for puncturing a wall of sock 36, as is clearly seen in FIG. 2. Shank acceptor 42 is integral with female member 26, and it includes a first tongue 46 having a first end 48, and a second tongue 50 having a second end 52. First end 48 and second end 52 are separable from each other to provide therebetween an opening for receiving shank 40.

One advantage of this arrangement is the ease with which male member 24 and female member 26 are secured together. Shank 40 is inserted through the wall of sock 36, and is then aligned with the junction between first end 48 and second end 52. The male and female members 24,26 are then squeezed together until sock 36 is partially penetrated by the teeth 54,56 attached to members 24,26. In this position, shank 40 is disposed between tongues 46,50, and first and second ends 48,52 are positioned within one of the notches 58 in the textured surface 60 of shank 40. As seen in FIG. 2, the engagement between notch surfaces 62,64 and first and second ends 48,52, respectively, prevents removal of shank 40 from shank acceptor 42. To eliminate the possibility of sharp tip 44 contacting a person wearing sock 36, female member 26 includes a back wall 66 for covering shank 40 and enclosing it within female member 26.

Tongues 46,50 are configured to have partial memory of their original, non-displaced, position. The placing of shank 40 between tongues 46,50, causes displacement of tongues 46,50, which results in ends 48,52 exerting recoil pressure against shank 40. As ends 48,52 are located at diametrically opposed sides of shank 40, the tongues 46,50 pinch shank 40 therebetween. In addition to facilitating a secure engagement between shank 40 and tongues 46,50, this pinching allows shanks with different diameters to be utilized independently with the same female member 26.

The attachment of members 28,30 to a wall of sock 38 is identical to the attachment of members 24,26 to a wall of sock 36. Shank 68 extends from male component 28, and after its sharp tip 70 punctures the wall of sock 38, it is placed between the ends 72,74 of tongues 76,78. The engagement between notch surfaces 80,82 and first and second ends 72,74, respectively, prevents removal of shank 68 from the shank acceptor 84. A back wall 86 covers sharp tip 70 of shank 68.

As mentioned previously, teeth 54,56 partially penetrate sock 36. These teeth 54,56 prevent rotation of pair 20 relative to sock 36. Similarly, teeth 88,90 partially penetrate sock 38 to prevent rotation of pair 22 relative to sock 38. As shown in FIG. 2, teeth 54,88 are offset from teeth 56,90 respectively. This offsetting arrangement of teeth 54,56,88, 90 allows each tooth to partially penetrate socks 36,38 without being inhibited by opposing teeth. The one way locking device of pairs 20,22 assures that the teeth 54,56, 88,90 remain in their partially penetrating position during all maneuvering and use of assembly 10. In prior art fasteners where there is not such a locking device connecting opposing male and female members, slippage of one member relative to the other member could result in a disengagement between the teeth and the material to which it is applied. This disengagement would result in undesired rotation of the fastener which could lead to the component parts becoming detached from each other.

Also preventing rotation of pairs 20,22 relative to socks 36,38 is a peripheral rim 92,94 attached to each male member 24,28. When pairs 20,22 are securely fixed upon their respective sock walls 36,38, a portion of each sock wall 36,38 is squeezed between rim 92,94 and female members 26,30. This squeezing secures the positioning of pairs 20,22 relative to sock wall 36,38. A second function of each rim 92,94 is to partially circumscribe female members 26,30 to add stability to each pair 20,22.

Figure 3:
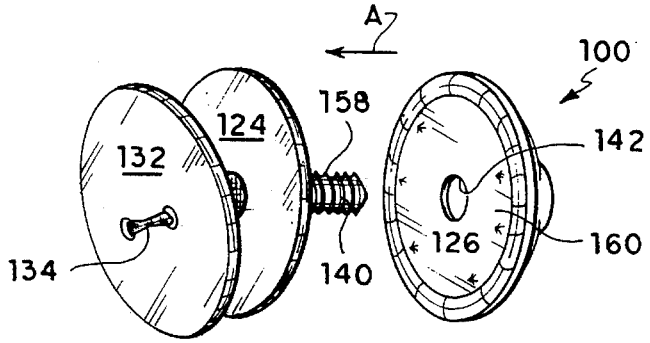
FIG. 3 is a perspective view of a second embodiment of the fastener assembly of the invention.
Figure 4:
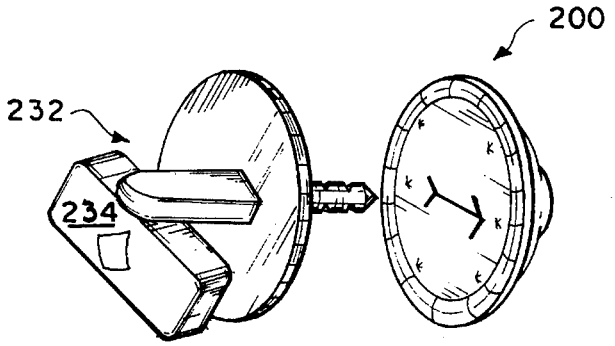
FIG. 4 is a perspective view of a third embodiment of the fastener assembly of the invention.

Alternative embodiments of the invention are illustrated in FIGS. 3 and 4. These embodiments each show fastener assemblies having only one pair of interlocking male and female members, with each pair including a coupling attachable directly to a garment or similar article. In FIG. 3, the coupling is a button 132 secured to a tethering line 134, which is illustrated to be flexible, but may also be rigid. In FIG. 4, the coupling is a cufflink 232 having a rotatable member 234 for placement through a standard button hole (not shown).

The embodiment of FIG. 3 depicts an alternative configuration of the one way locking device. Here, shank 140 of fastener assembly 100 includes a plurality of ribs 158, and the shank acceptor is an opening 142 in female member 126.

Ribs 158 are configured to be capable of being deflected only in the direction of arrow A. Therefore, movement of shank 140 into opening 142 causes a portion of each rib 158 to engage the material 160 which surrounds opening 142. When contacted in this manner, ribs 158 deflect to permit passage of shank 140 into opening 142, permitting members 124,126 to retain their position after being squeezed together. However, upon attempted removal of shank 140 from opening 142, ribs 158 oppose removal of shank 140.

Figure 5:
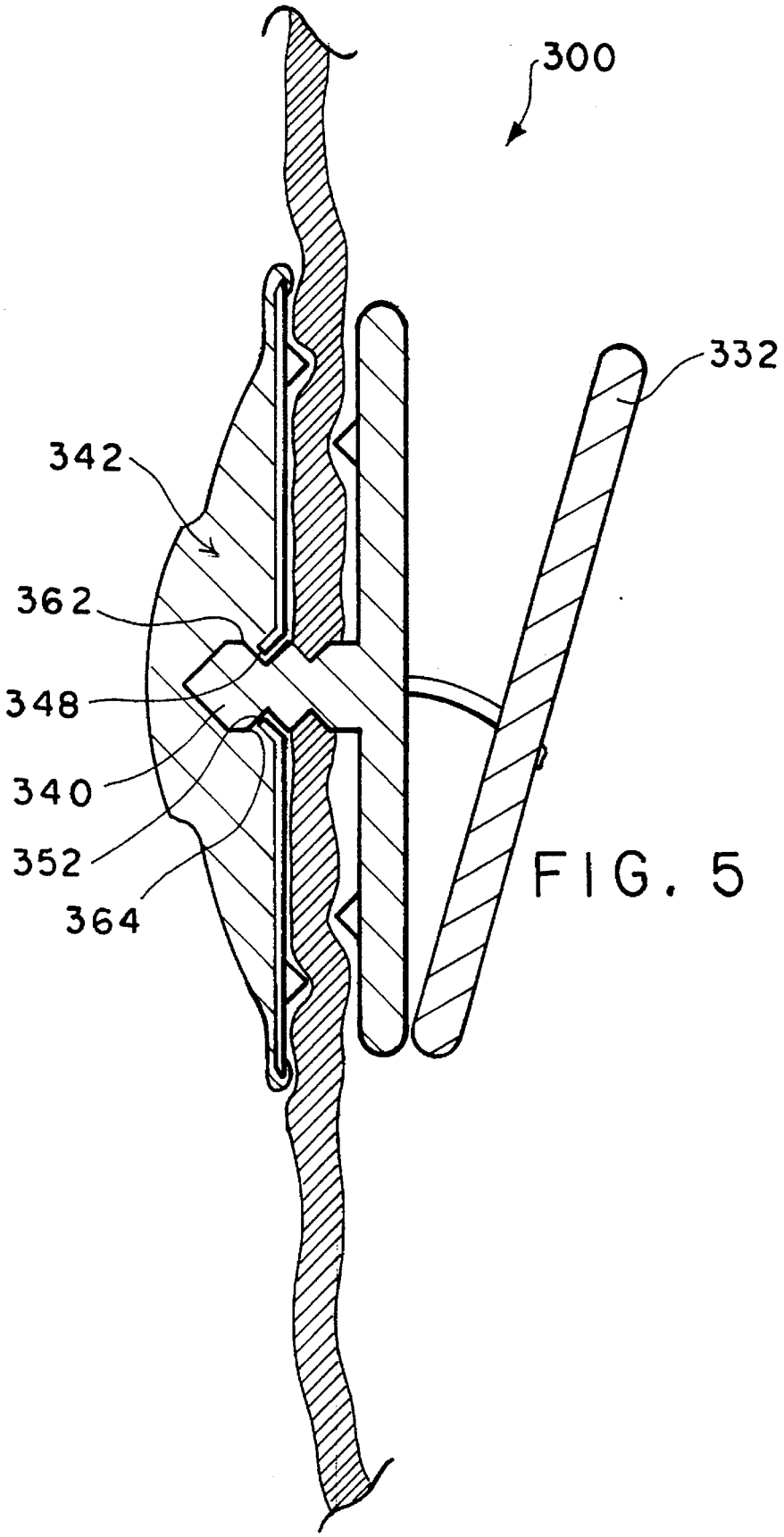
FIG. 5 is an environmental, front elevational view in cross section of a fourth embodiment of the present invention.

Fastener assemblies 100,200 are illustrative modifications of assembly 10. If desired, any of the above mentioned couplings could be affixed to interlocking members having either one way locking device of assemblies 10,200 or the one way locking device of assemblies 100. An example is illustrated in the cross sectional view of FIG. 5, where a fastening assembly 300 includes a button 332 as a coupling, and a one way locking device identical to that illustrated for assemblies 10 and 100. The engagement between notch surfaces 362,364 and first and second ends 348,352, respectively, prevents removal of shank 340 from shank acceptor 342.

It is to be understood that the present invention is not limited to the embodiments described above, but encompasses any and all embodiments within the scope of the following claims.

We claim:

1. A fastener assembly for joining fabric, said fastener assembly comprising:

a first pair of interlocking members including, a first male member having an outside surface and an adjacent inside surface, said first male member including a first shank centrally extending from said inside surface, and a first female member separate from said first male member, said first female member having an interior surface including a first shank acceptor for frictionally securing said first shank within said first female member, said first shank configured to penetrate the fabric to permanently secure the fabric between said first pair of said interlocking members;

a second pair of interlocking members including, a second male member having an outside surface and an adjacent inside surface, said second male member including a second shank centrally extending from said inside surface, and a second female member separate from said second male member, said second female member having an interior surface including a second shank acceptor for frictionally securing said second shank within said second female member, said second shank configured to penetrate the fabric to permanently secure the fabric between said second pair of interlocking members; and coupling means for removably securing said first pair of interlocking members to said second pair of interlocking members, said coupling means including an engaging part extending from the outside surface of said first male member and a socket extending from the outside surface of said second male member, said socket frictionally and removably securing said engaging part therein.

2. The fastener assembly according to claim 1, wherein said first shank includes at least one notch therein and said second shank includes at least one notch therein.

3. The fastener assembly according to claim 1, further comprising:

a first plurality of teeth affixed to each said female member; and a second plurality of teeth affixed to each said male member.

4. The fastener assembly according to claim 3, wherein each tooth of said first plurality of teeth is offset from each tooth of said second plurality of teeth.

5. The fastener assembly according to claim 1, wherein each said female member includes a peripheral rim dimensioned and configured to at least partially circumscribe said male member associated therewith.

6. The fastener assembly according to claim 1, wherein said engaging part comprises a ball.

* * * * *